US008979625B2

(12) United States Patent
Englman et al.

(10) Patent No.: US 8,979,625 B2
(45) Date of Patent: Mar. 17, 2015

(54) WAGERING GAME SYSTEM WITH SHARED COMMUNITY PREFERENCES

(71) Applicant: WMS Gaming Inc., Waukegan, IL (US)

(72) Inventors: Allon G. Englman, Chicago, IL (US); Daniel P. Louie, Chicago, IL (US); Steven J. Zoloto, Highland Park, IL (US)

(73) Assignee: WMS Gaming Inc., Waukegan, IL (US)

( * ) Notice: Subject to any disclaimer, the term of this patent is extended or adjusted under 35 U.S.C. 154(b) by 185 days.

(21) Appl. No.: 13/622,876

(22) Filed: Sep. 19, 2012

(65) Prior Publication Data

US 2013/0017885 A1 Jan. 17, 2013

Related U.S. Application Data

(63) Continuation of application No. 13/002,023, filed as application No. PCT/US2009/049068 on Jun. 29, 2009, now Pat. No. 8,292,719.

(60) Provisional application No. 61/133,514, filed on Jun. 30, 2008.

(51) Int. Cl.
*A63F 9/24* (2006.01)
*G07F 17/32* (2006.01)

(52) U.S. Cl.
CPC ..... *G07F 17/3272* (2013.01); *G07F 17/32* (2013.01); *G07F 17/3244* (2013.01); *G07F 17/3267* (2013.01)
USPC ..... 463/16; 463/20; 463/25; 463/29

(58) Field of Classification Search
USPC ..... 463/16–20, 25–29
See application file for complete search history.

(56) References Cited

U.S. PATENT DOCUMENTS

| | | | | |
|---|---|---|---|---|
| 5,393,057 | A | 2/1995 | Marnell, II | 273/85 CP |
| 6,068,552 | A | 5/2000 | Walker et al. | |
| 6,068,553 | A | 5/2000 | Parker | 463/27 |
| 6,110,041 | A | 8/2000 | Walker et al. | |
| 6,254,483 | B1 | 7/2001 | Acres | |
| 6,293,866 | B1 | 9/2001 | Walker et al. | |

(Continued)

FOREIGN PATENT DOCUMENTS

| | | |
|---|---|---|
| WO | WO 2006/125013 A2 | 11/2006 |
| WO | WO 2007/127259 A2 | 11/2007 |

(Continued)

OTHER PUBLICATIONS

PCT International Search Report for International Application No. PCT/US2009/049068 dated Aug. 13, 2009 (2 pages).

(Continued)

*Primary Examiner* — Omkar Deodhar
(74) *Attorney, Agent, or Firm* — Nixon Peabody LLP

(57) ABSTRACT

A computer-implemented method is conducted in a gaming system including a plurality of gaming terminals that participate in a community event. The method includes associating, by at least one of one or more processors, sets of one or more individual preferences with respective players at the respective gaming terminals. The method further include determining by at least one of the one or more processors, based on the sets of individual preferences, a set of one or more community preferences that govern the community event.

22 Claims, 8 Drawing Sheets

(56) References Cited

U.S. PATENT DOCUMENTS

| | | | | |
|---|---|---|---|---|
| 6,342,010 | B1 | 1/2002 | Slifer | |
| 6,350,199 | B1 | 2/2002 | Williams et al. | |
| 6,520,856 | B1 | 2/2003 | Walker et al. | |
| 6,628,939 | B2 | 9/2003 | Paulsen | |
| 6,749,510 | B2 | 6/2004 | Giobbi | |
| 6,758,754 | B1 * | 7/2004 | Lavanchy et al. | 463/42 |
| 6,769,986 | B2 | 8/2004 | Vancura | |
| 7,033,276 | B2 | 4/2006 | Walker et al. | |
| 7,040,987 | B2 | 5/2006 | Walker et al. | |
| 7,169,052 | B2 | 1/2007 | Beaulieu et al. | |
| 7,431,646 | B2 | 10/2008 | Jackson | 463/16 |
| 7,559,838 | B2 | 7/2009 | Walker et al. | |
| 7,662,040 | B2 | 2/2010 | Englman et al. | 463/42 |
| 7,722,453 | B2 | 5/2010 | Lark et al. | |
| 7,753,789 | B2 | 7/2010 | Walker et al. | |
| 7,780,531 | B2 | 8/2010 | Englman et al. | 463/42 |
| 7,798,899 | B2 | 9/2010 | Acres | |
| 7,883,413 | B2 | 2/2011 | Paulsen | |
| 7,918,728 | B2 | 4/2011 | Nguyen et al. | |
| 7,918,738 | B2 | 4/2011 | Paulsen | |
| 8,087,988 | B2 | 1/2012 | Nguyen et al. | |
| 8,172,682 | B2 | 5/2012 | Acres et al. | |
| 8,187,073 | B2 | 5/2012 | Beaulieu et al. | |
| 8,221,245 | B2 | 7/2012 | Walker et al. | |
| 8,282,475 | B2 | 10/2012 | Nguyen et al. | |
| 8,425,332 | B2 | 4/2013 | Walker et al. | |
| 8,435,105 | B2 | 5/2013 | Paulsen | |
| 2002/0142846 | A1 | 10/2002 | Paulsen | |
| 2003/0011127 | A1 | 1/2003 | Vancura et al. | 273/236 |
| 2004/0048657 | A1 | 3/2004 | Gauselmann | |
| 2004/0142747 | A1 | 7/2004 | Pryzby | |
| 2004/0166940 | A1 | 8/2004 | Rothschild | |
| 2004/0180712 | A1 | 9/2004 | Forman et al. | |
| 2005/0003886 | A1 | 1/2005 | Englman et al. | 463/25 |
| 2005/0043092 | A1 | 2/2005 | Gauselmann | |
| 2005/0170890 | A1 | 8/2005 | Rowe et al. | |
| 2005/0277469 | A1 | 12/2005 | Pryzby et al. | |
| 2006/0009283 | A1 * | 1/2006 | Englman et al. | 463/29 |
| 2006/0178189 | A1 | 8/2006 | Walker et al. | |
| 2006/0252522 | A1 | 11/2006 | Walker et al. | |
| 2006/0252523 | A1 | 11/2006 | Walker et al. | |
| 2008/0214289 | A1 | 9/2008 | Pryzby et al. | 463/25 |
| 2010/0029367 | A1 | 2/2010 | Englman et al. | 463/20 |
| 2010/0137047 | A1 | 6/2010 | Englman et al. | 463/6 |
| 2010/0298040 | A1 | 11/2010 | Joshi et al. | |

FOREIGN PATENT DOCUMENTS

| | | | |
|---|---|---|---|
| WO | WO 2008/024330 | A2 | 2/2008 |
| WO | WO 2008/045398 | A2 | 4/2008 |
| WO | WO 2009/061383 | A1 | 5/2009 |
| WO | WO 2009/061463 | A1 | 5/2009 |
| WO | WO 2010/002794 | A1 | 1/2010 |

OTHER PUBLICATIONS

PCT International Written Opinion for International Application No. PCT/US2009/049068 dated Aug. 13, 2009 (5 pages).

* cited by examiner

WAGERING GAME SYSTEM WITH SHARED COMMUNITY PREFERENCES

CROSS REFERENCE TO RELATED APPLICATIONS

This application is a continuation of U.S. patent application Ser. No. 13/002,023, titled "Wagering Game With Shared Outcome Providing Individual Awards To Players," filed on Dec. 29, 2010, now allowed, which is a U.S. national stage of International Application No. PCT/US2009/049068, titled "Wagering Game With Shared Outcome Providing Individual Awards To Players" and filed on Jun. 29, 2009, which claims priority to U.S. Provisional Patent Application Ser. No. 61/133,514, titled "Wagering Game With Shared Outcome Providing Individual Awards To Players" and filed on Jun. 30, 2008, each of which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system for playing a community event in which community preferences are adjusted based on individual preferences.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a computer-implemented method is conducted in a gaming system including a plurality of gaming terminals that participate in a community event. The method includes associating, by at least one of one or more processors, sets of one or more individual preferences with respective players at the respective gaming terminals. The method further include determining by at least one of the one or more processors, based on the sets of individual preferences, a set of one or more community preferences that govern the community event.

According to another aspect of the invention, a computer-implemented method is conducted in a gaming system including first and second gaming terminals that participate in a community event. The method includes presenting wagering games at the respective first and second gaming terminals and, in response to receiving one or more first preference settings, adjusting a first set of one or more individual preferences associated with a first player at the first gaming terminal. The method further includes, in response to receiving one or more second preference settings, adjusting a second set of one or more individual preferences associated with a second player at the second gaming terminal. The community event, in which the first and second gaming terminals participate, is triggered by one or more processors. Based on the first and second sets of individual preferences, a set of community preferences is determined by at least one of the one or more processors. The set of community preferences is applied, by at least one of the one or more processors, to the community event.

According to yet another aspect of the invention, a computer-implemented method is conducted in a gaming system including first and second gaming terminals that participate in a community event. The method includes presenting wagering games at the respective first and second gaming terminals, and adjusting, in response to receiving individual settings, respective sets of one or more individual preferences associated with players at the first and second gaming terminals. The community event, in which at least one randomly selected outcome is shared by the first and second gaming terminals, is triggered by one or more processors. Based on the sets of individual preferences, a set of community preferences is determined by at least one of the one or more processors. The set of community preferences is applied, by at least one of the one or more processors, to the community event.

According to yet another aspect of the invention, a plurality of gaming terminals include one or more processors and one or more memory devices storing instructions that, when executed by at least one of the one or more processors, cause the gaming system to present wagering games at the respective gaming terminals. In response to receiving individual preference settings, the instructions cause adjusting of respective sets of one or more individual preferences associated with players at the respective gaming terminals. A community event, in which the gaming terminals participate, is triggered, and, based on the sets of individual preferences, a set of community preferences is determined The set of community preferences is applied to the community event.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
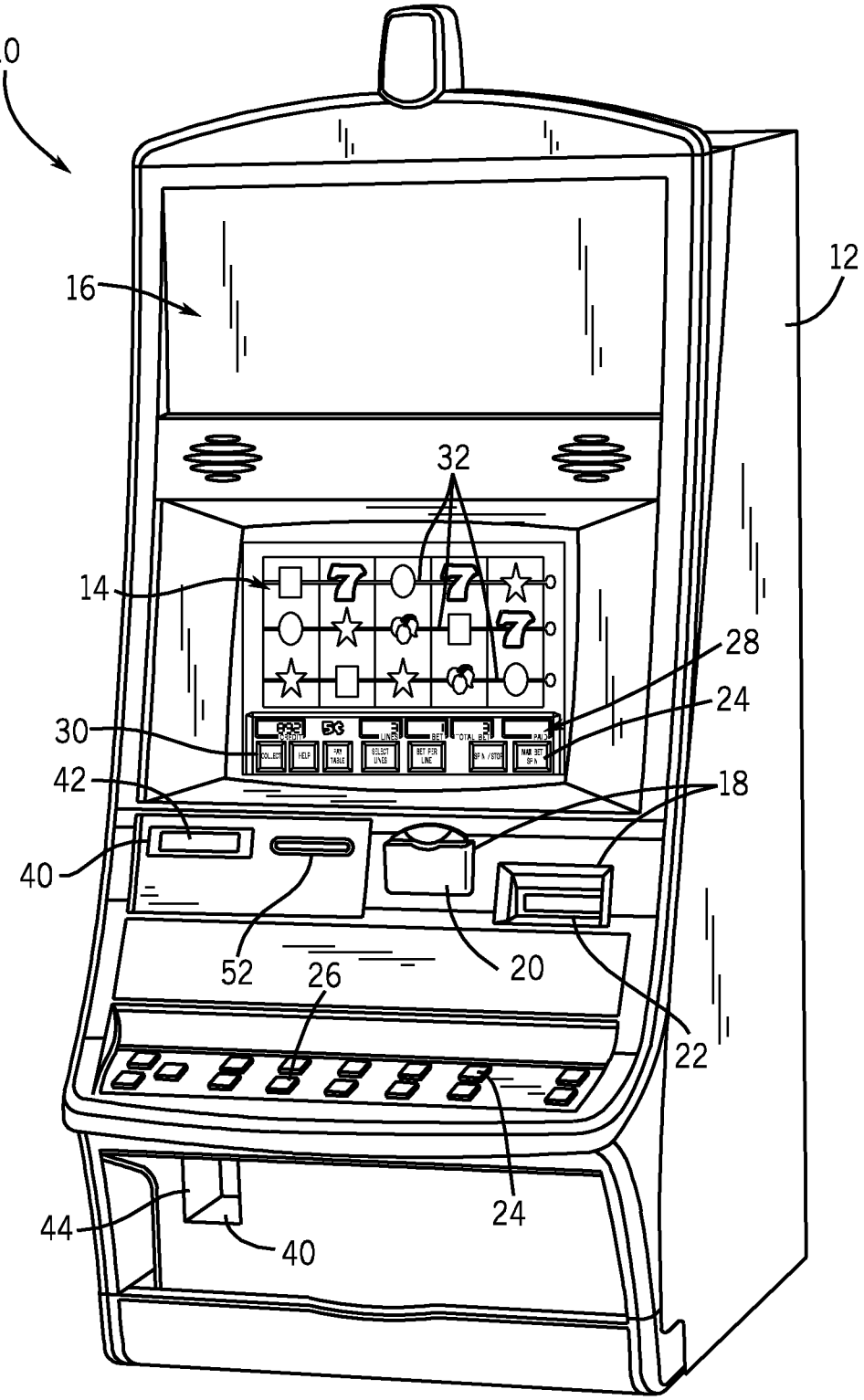
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
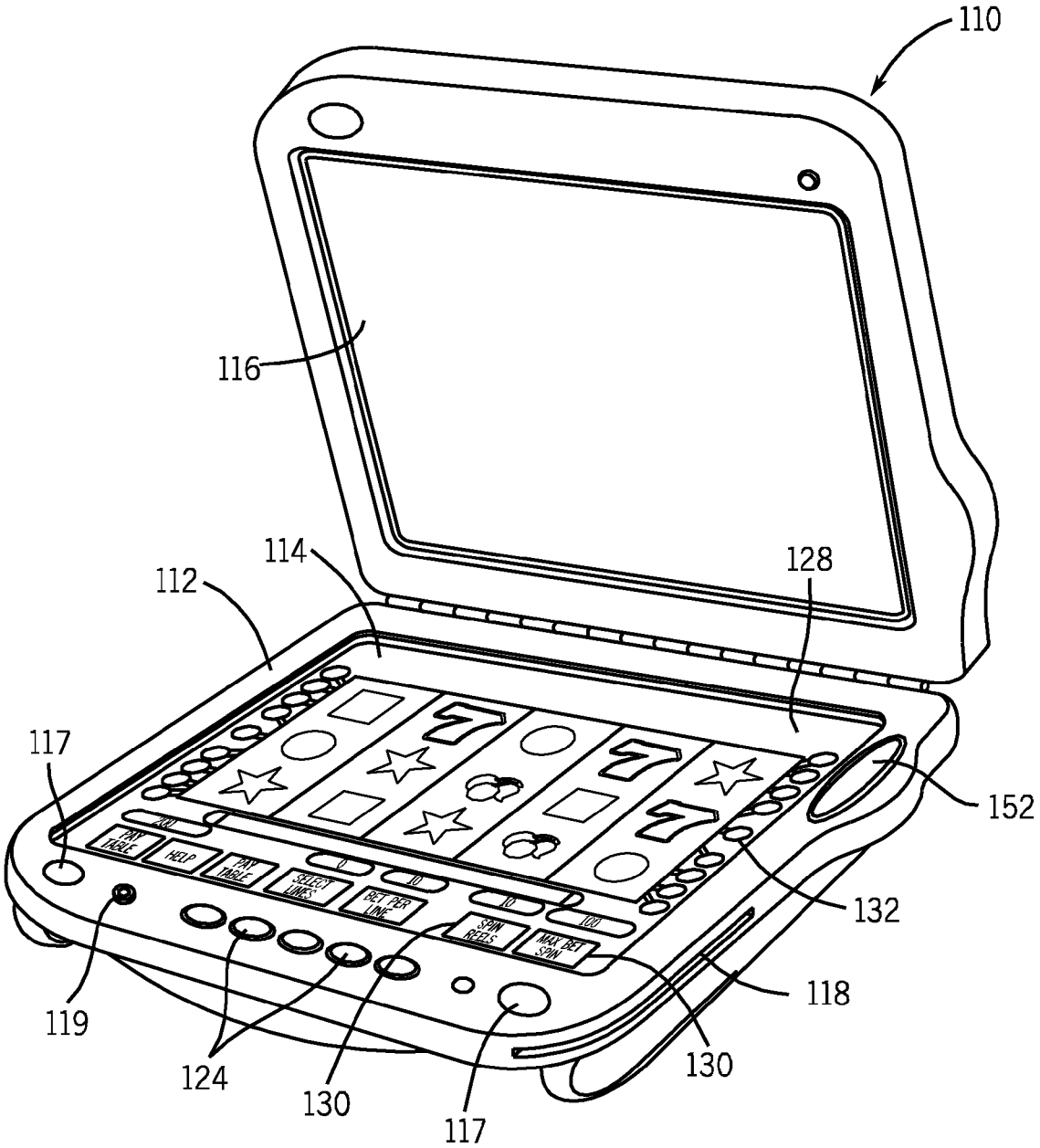
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
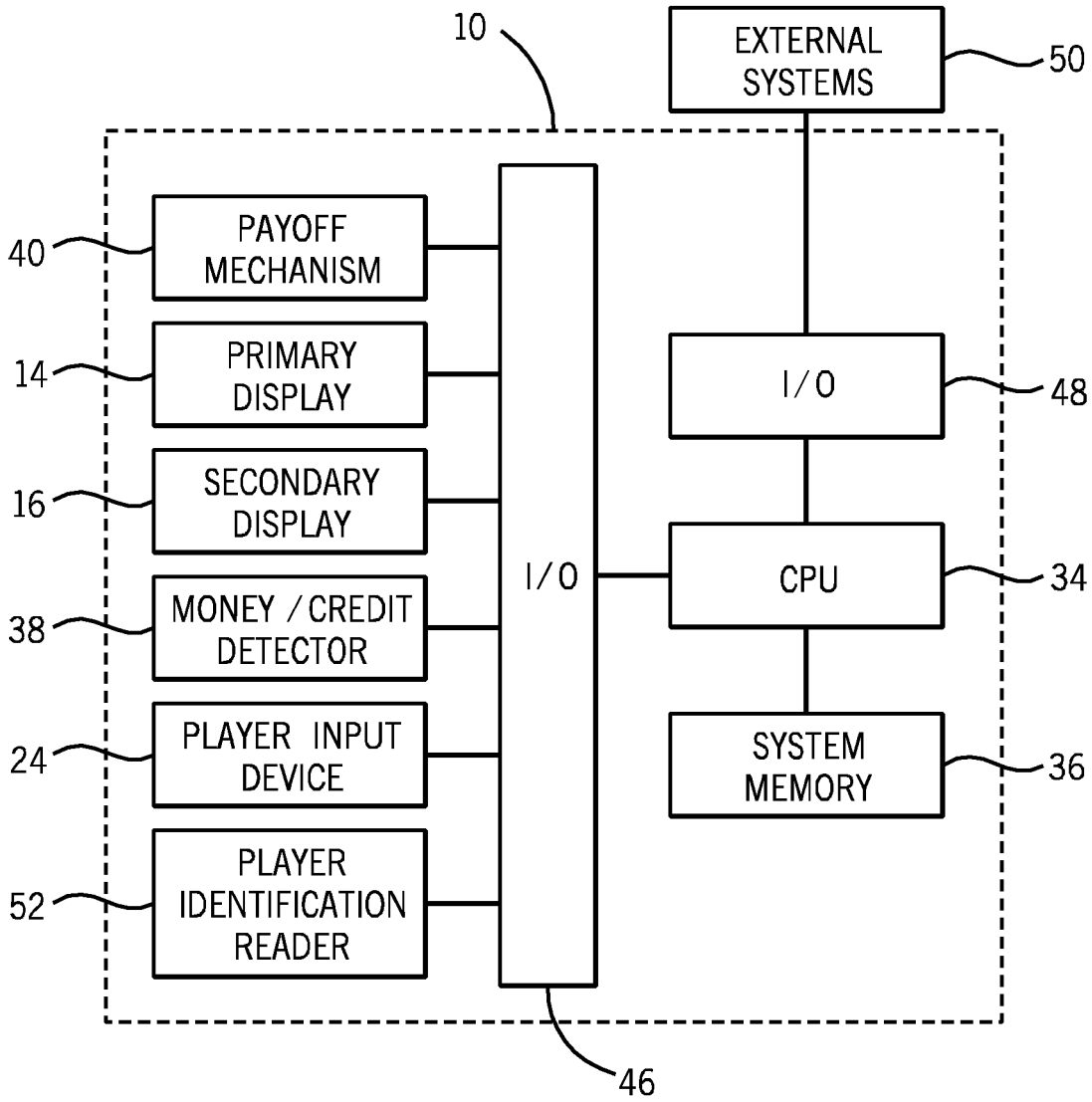
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display (s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Security features are advantageously utilized where the gaming machines 10,110 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to a(nother) network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, Establishing Wireless Robust Security Networks: A Guide to IEEE 802.11, and SP 800-48, Wireless Network Security: 802.11, Bluetooth and Handheld Devices, both of which are incorporated herein by reference in their entirety.

Figure 3:
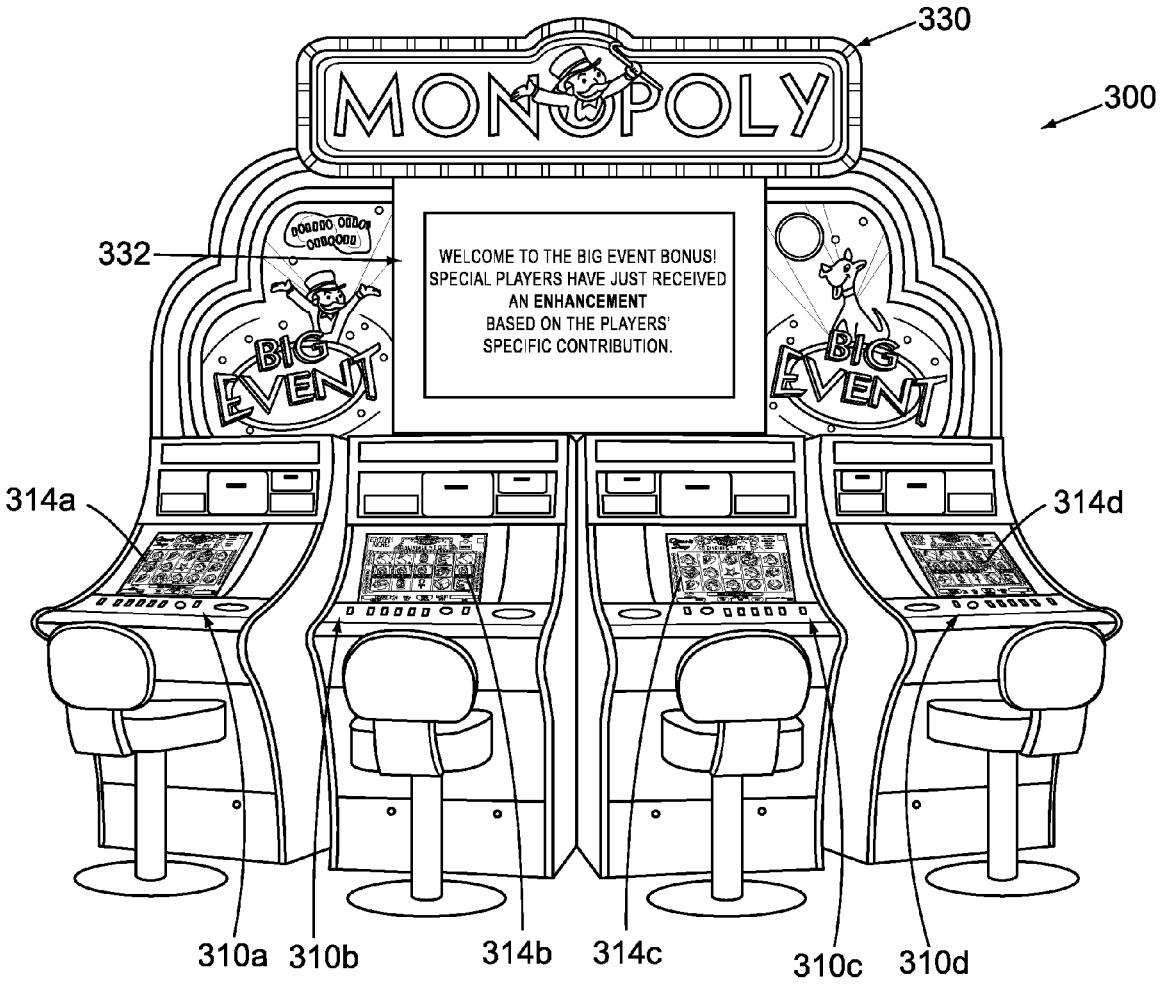
FIG. 3 is a perspective view of a gaming system of interconnected video gaming machines and signage according to one embodiment of the present invention.

Referring now to FIG. 3, a gaming system 300 includes a bank of gaming terminals 310*a*-*d* and is illustrated in accordance with one embodiment of the present invention. The gaming terminals 310*a*-310*d* are of the type described above with respect to FIGS. 1*a*-2 or of any other type of gaming terminal suitable for operating a wagering game. The gaming terminals 310*a*-310*d*, which include respective terminal displays 314*a*-314*d*, are interconnected and included under a signage 330. The signage 330 includes a community display 332 for displaying a community event thereon, such as a MONOPOLY ONCE AROUND™ game or any community event. The community event provides qualified players the opportunity to participate in a communal wagering game in which each outcome is shared by a plurality of players. According to one embodiment, the community display 332 includes one or more plasma displays visible to each player seated at the bank of gaming terminals 310*a*-310*d*.

The signage 330 includes a signage controller (not shown) that is connected to each of the four gaming terminals 310*a*-310*d*. The signage controller transmits information to and receives information from the CPU 34 (FIG. 2) in each of the four gaming terminals 310*a*-310*d* throughout the game. The gaming system 300 allows for various aspects of the gaming terminals 310*a*-310*d*, such as playing progressive games or any other community events, to be controlled through the signage controller in the signage 330. Thus, all of the gaming terminals 310*a*-310*d* are linked to the community event that is being played.

In general, players conduct base wagering games on the gaming terminals 310*a*-310*d*, which are respectively displayed on the terminal displays 314*a*-314*d*. In response to a community event being triggered, such as a BIG EVENT™ bonus game, a plurality of qualified gaming terminals are selected from the gaming terminals 310*a*-310*d* (and/or, optionally, other gaming terminals) to participate in the community event. The community event may be initiated by achieving a winning combination of symbols on any of the gaming machines 310*a*-310*d* within the bank or by the signage controller independent of the symbols appearing on the gaming machines 310*a*-310*d*. When the community event is triggered, eligible players receive something extra, such as an enhancement, based on certain wagering criteria. Optionally, the community display 332 can include a notification to make the players aware that "Special Players Have Just Received an Enhancement Based On The Players' Specific Contribution."

According to one embodiment, the players are selected based on their time eligibility as determined by their recent wager history. Time eligibility is measured using, for example, a time slice, which is the amount of time that a wagered amount gives eligibility to the player for entry into the communal wagering game. A time-slice counter is used to increment and/or decrement time slices for increasing and/or decreasing the time that the player is eligible to participate in the communal wagering game. If the player has eligibility during an increment of time when the community event is triggered, then the player is allowed to play the communal wagering game. In addition to receiving an enhancement upon triggering the community event, the player may also be provided with an enhancement within the communal wagering game based on wagering criteria, such as the player's betting history. In other embodiments, the length of the gaming session, total credits wagered, speed of play, credits earned, etc., can be used to determine the player's enhancement. The enhancement may include a plurality of levels that can be earned by the player by wagering on the basic wagering game. Each level has a certain maximum number of purchasable time slices.

Figure 4:
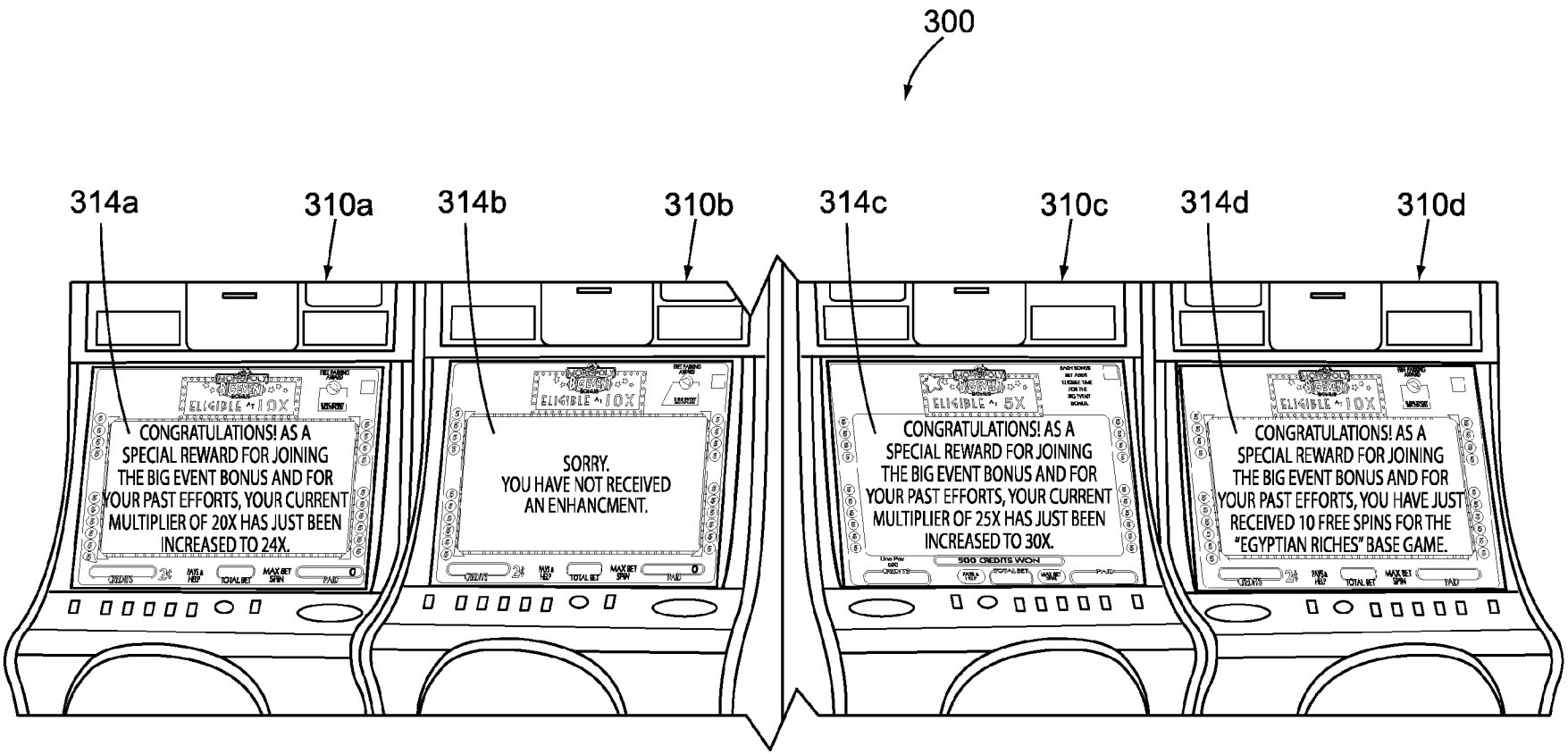
FIG. 4 is a partial front view illustration of the gaming machines of FIG. 3 showing an enhancement aspect of a community event being conducted on the gaming system of FIG. 3.

Referring to FIG. 4, all four gaming terminals 310*a*-310*d* of the gaming system 300 have qualified to participate in the community event. The players of the gaming terminals 310*a*-310*d* receive enhancements in accordance with their specific wagering criteria. Optionally, each player receives a notification on the respective terminal display 314*a*-314*d* to more clearly convey what enhancement the player has just received.

For example, a Player A of the gaming terminal 310*a* has been rewarded by increasing a current multiplier (20× multiplier value) to a higher multiplier (24× multiplier value). In contrast, a Player B of the gaming terminal 310*b* has not been deemed eligible to receive any enhancements.

Similar to Player A, a Player C of the gaming terminal 310*c* has been reward by increasing a current multiplier (25× multiplier value) to a higher multiplier (30× multiplier value). However, because Player C had achieved a higher multiplier value than Player A (i.e., 25× multiplier value vs. 20× multiplier value), Player C is rewarded accordingly by receiving a much higher multiplier value than Player A (i.e., 30× multiplier value vs. 24× multiplier value).

A Player D of the gaming terminal 310*d* has also been rewarded with an enhancement. However, instead of an increased multiplier, Player D receives 10 free spins for playing in a base wagering game (e.g., 10 free spins for playing in an EGYPTIAN RICHES™ base game).

Figure 5:
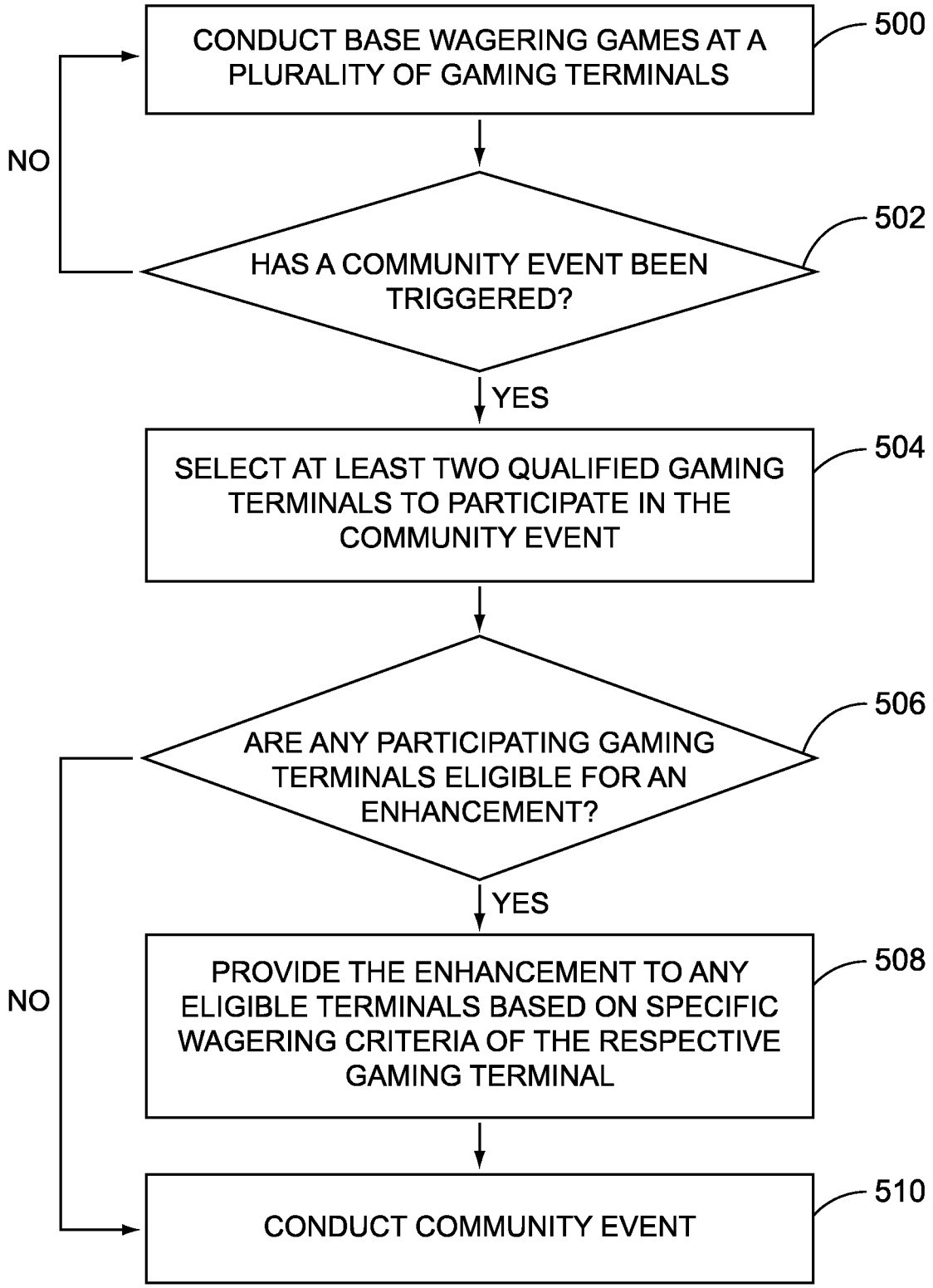
FIG. 5 is a flow chart describing an enhancement aspect of the community event being conducted on the gaming system of FIG. 3.

Referring to FIG. 5, a plurality of players conduct base wagering games at respective gaming terminals of a plurality of gaming terminals (500). If a community event is triggered (502), at least two qualified gaming terminals are selected to participate in the community event (504). If any of the participating gaming terminals are eligible for an enhancement (506), an enhancement is provided based on specific wagering criteria at the respective gaming terminal (508). Then, the community event is conducted (510).

The enhancement, such as a BIG EVENT™ Booster, can include one or more features that provide, or are perceived to provide, a reward to the player. For example, the enhancement can include an extra credits award (e.g., an instant Little Event award); an added elite bonus that plays after the BIG EVENT™ bonus game; sharing of a BIG EVENT™ Progressive or simulated progressive; a number of free base wagering game spins; and/or extra seconds of eligibility for a next community event (such as the BIG EVENT™ bonus game).

Optionally, or alternatively, the enhancement can affect play during base or other bonus wagering games. For example, the enhancement can include a two bonus symbols hold and respin feature, one or more pooper savers in a picking bonus game, extra free spins in a free spin bonus game, etc.

Figure 6:
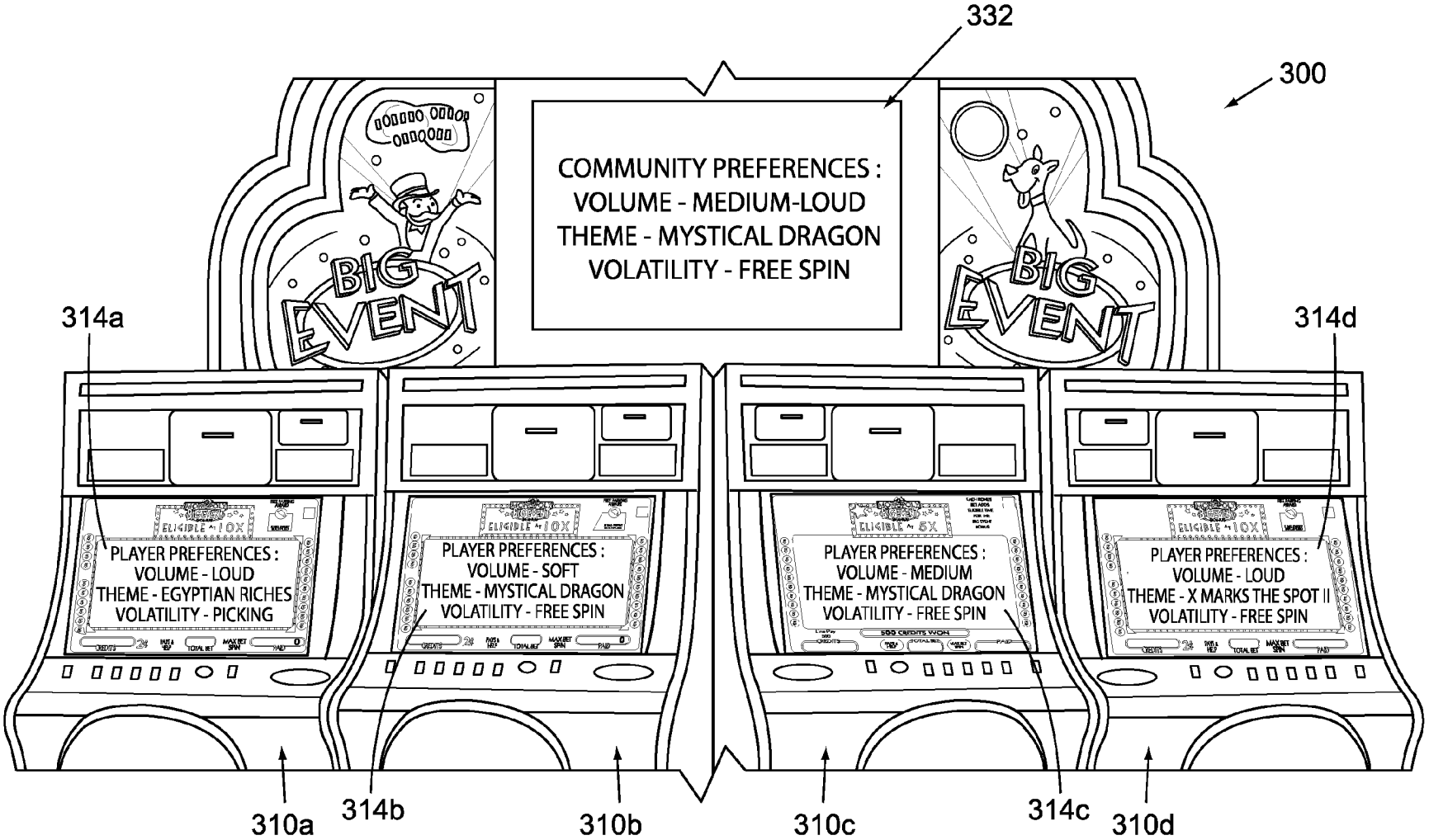
FIG. 6 is a partial front view illustration of the gaming system of FIG. 3 showing setting of community preferences.

Referring to FIG. 6, community preferences can be adjusted based on an analysis of individual preferences. The analysis, for example, can be a simple determination of an average preference based on individual preferences. Some examples of community preferences that can be averaged out include volume of community event, theme of community event, volatility of community event, etc.

According to the shown exemplary embodiment, Player A of gaming terminal 310*a* prefers a Loud volume setting, an EGYPTIAN RICHES™ theme, and a picking feature (in contrast to a free spin feature). Player B of gaming terminal 310*b* prefers a Soft volume setting, a MYSTICAL DRAGON™ theme, and the free spin feature. Player C of gaming terminal 310*c* prefers a Medium volume setting, the MYSTICAL DRAGON™, and the free spin feature. Player D of gaming terminal 310*d* prefers the Loud volume setting, a X MARKS THE SPOT II™ theme, and the free spin feature. The individual preferences can be optionally displayed in the respective terminal display of the terminal displays 314*a*-314*d*.

Based on the personal preferences of each of Players A-D, the community preferences are determined. For example, the community preferences are determined to be a Medium-Loud volume setting, the MYSTICAL DRAGON™ theme, and the free spin feature. Optionally, the community preferences are shown in the community display 332.

Figure 7:
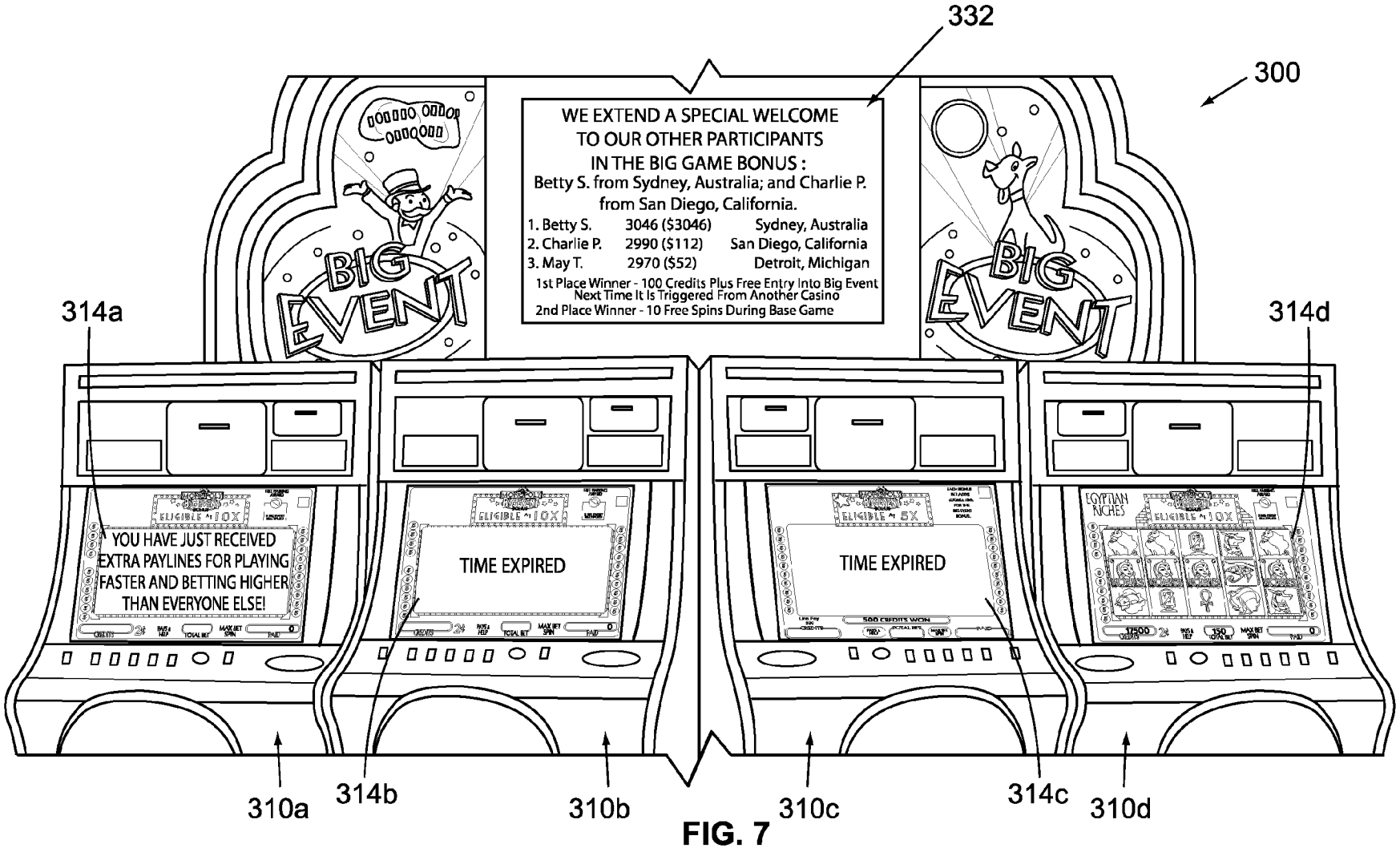
FIG. 7 is a partial front view illustration of the gaming system of FIG. 3 showing various player participation notifications for the community event being conducted on the gaming system of FIG. 3.

Referring to FIG. 7, a World Leader community event, such as the BIG EVENT™, can be conducted on the gaming system 300. The World Leader community event provides a player with a chance to play not only against players within the gaming system 300, but also against players at other gaming establishments (e.g., casinos around the world.

According to one example, players on the gaming system can always compete with a set number of players. For example, the set number of players can be the number of players in the gaming system plus one more player. As such, according to this exemplary embodiment, competing players on the gaming system 300 will always include 5 players (4 players on the gaming terminals 310*a*-310*d*+1 more player from a different geographical location).

If only some of the players on the gaming system 300 qualify for the community event, additional players are selected from other casinos from around the world. For example, the gaming system 300 requires 5 players to participate in the community event. If only 3 players qualify when a BIG EVENT™ community event is triggered, 2 additional players are entered from other casinos. Referring to the community display 332, a notification can show the names of the additional world participants, e.g., "We Extend A Special Welcome To Our Other Participants In The Big Game Bonus: Betty S. from Sydney, Australia; and Charlie P. from San Diego, Calif."

Optionally, the community display 332 can display information related to world leader scores, e.g., all-time highest scores, names, locations, and progressive values. For example, the community display 332 can display that "Betty S." is a top scorer, having "3046" points and having won "$3,046." The community display 332 can also display the location in which the player has accumulated part or all of the points, e.g., "Las Vegas, Nev.," "Atlantic City, N.J.," etc.

According to an alternative embodiment, if one of three all-time high scores is beat, the player receives a progressive prize and receives an option to input their name, which is entered into a permanent leaderboard along with the player's location. The player can play again and again.

Optionally, if a specific score is beat, the player with the higher score can receive a reward. For example, if the highest all-time score is beat, the player can receives one dollar for every point the player has won in a slot tournament.

The community display 332 can also display awards for the world players. For example, a first place winner can receive credits plus a free entry into a BIG EVENT™ bonus game the next time it is triggered. Optionally, the first place winner can receive a free entry only when the BIG EVENT™ bonus game is triggered from another casino. A second place winner can receive credits or free spins in a base wagering game. Other players can receive consolation credits, or nothing.

The World Leader community event can have various features and options. For example, a player of gaming terminal 310*a* may be notified on the terminal display 314*a* that extra paylines have been received because the player has been betting higher and has been playing faster than everyone else. The more paylines the player has, the more opportunities at scoring higher. Thus, the player will likely wish to have as many paylines as possible.

Other players, such as players at two other gaming terminals 310*b*, 310*c*, may receive nothing after time expires. Yet other players, such as the player at another gaming terminal 310*d*, may simply be conducting a base wagering game (such as an EGYPTIAN RICHES™ themed base game) during the World Leader community event.

Other features and options can include playing base games with multiple themes and bonuses; triggering a community event every 5 minutes on average; deeming eligible to play in a slot tournament all players that have placed an extra bet; changing a player's five-reel video screen into a three-reel video old-style classic slot with 7s, bars, cherries, etc.; increasing point payback percentage to a higher percentage (e.g., 98 percent); and displaying scores of other players competing in the gaming system 300 and one or more players that have won a slot tournament form a different casino.

The World Leader community event can, optionally, include a time period during which the participating compete to receive the highest score possible. For example, after a countdown, players can have 60 seconds during which they pound a button to obtain the highest score.

According to another alternative embodiment, a player can play multiple games on one gaming terminal of gaming terminals 310*a*-310*d* to increase a value associated with a particular feature. For example, the player can play multiple base wagering games to receive a higher cumulative multiplier or multiple individual multipliers.

Each of these embodiments and obvious variations thereof is contemplated as falling within the spirit and scope of the claimed invention, which is set forth in the following claims.

What is claimed is:

1. A method of operating a gaming system, the gaming system including one or more random element generators, one or more processors, and a plurality of gaming terminals that are primarily dedicated to playing respective casino wagering games and that participate in a community event, each gaming terminal of the plurality of gaming terminals including an electronic display device and an electronic input device, the method comprising:

generating, by at least one of the one or more random element generators, one or more random elements for the respective casino wagering games;

receiving, responsive to physical inputs to electronic input devices of the respective plurality of gaming terminals, wager inputs to initiate the respective casino wagering games;

determining, by at least one of the one or more processors, outcomes of the respective casino wagering games based, at least in part, on the respective one or more random elements;

displaying the outcomes on the electronic display devices of the respective gaming terminals;

selecting, by at least one of the one or more processors, the plurality of gaming terminals to participate in the community event independently of one or more individual preferences;

associating, by at least one of the one or more processors, sets of the one or more individual preferences with respective players at the respective gaming terminals; and based on the sets of individual preferences, determining, by at least one of the one or more processors, a set of one or more community preferences that govern the community event.

2. The computer-implemented method of claim 1, wherein the individual preferences are selected from a group consisting of a volume preference, a theme preference and a game format preference.

3. The computer-implemented method of claim 1, wherein the individual preferences include an individual volume preference, the individual volume preference being selected from a group consisting of at least a loud volume setting, a medium volume setting, and a soft volume setting, and wherein the community preferences include a community volume setting based on the individual volume preferences associated with the respective players at the respective gaming terminals.

4. The computer-implemented method of claim 1, wherein the community event is triggering during play of the casino wagering games at the respective gaming terminals.

5. The computer-implemented method of claim 1, wherein the determining of the set of community preferences includes averaging corresponding preferences in the sets of individual preferences.

6. The computer-implemented method of claim 1, further comprising displaying the set of community preferences on a community display.

7. The computer-implemented method of claim 1, further comprising displaying the sets of individual preferences on one or more of the electronic display devices.

8. A method of operating a gaming system, the gaming system including one or more random element generators, one or more processors, and first and second gaming terminals that are primarily dedicated to playing respective casino wagering games and that participate in a community event, each of the first and second gaming terminals including an electronic display device and an electronic input device, the method comprising:

generating, by at least one of the one or more random element generators, one or more random elements for the respective casino wagering games;

receiving, responsive to physical inputs to the electronic input devices of the respective first and second gaming terminals, wager inputs to initiate the casino wagering games at the respective first and second gaming terminals;

determining, by at least one of the one or more processors, outcomes of the respective casino wagering games based, at least in part, on the respective one or more random elements;

displaying the outcomes on the electronic display devices of the respective first and second gaming terminals;

selecting, by at least one of the one or more processors, the first and second gaming terminals to participate in the community event independently of one or more individual preferences;

in response to receiving one or more first preference settings, adjusting a first set of the one or more individual preferences associated with a first player at the first gaming terminal;

in response to receiving one or more second preference settings, adjusting a second set of the one or more individual preferences associated with a second player at the second gaming terminal;

triggering, by at least one of the one or more processors, the community event in which the first and second gaming terminals participate;

based on the first and second sets of individual preferences, determining, by at least one of the one or more processors, a set of community preferences; and applying, by at least one of the one or more processors, the set of community preferences to the community event.

9. The computer-implemented method of claim 8, wherein the individual preferences are selected from a group consisting of a volume preference, a theme preference and a game format preference.

10. The computer-implemented method of claim 8, wherein the individual preferences include an individual volume preference, the individual volume preference being selected from a group consisting of at least a loud volume setting, a medium volume setting, and a soft volume setting, and wherein the community preferences include a community volume setting based on the individual volume preferences associated with the respective first and second players at the respective first and second gaming terminals.

11. The computer-implemented method of claim 8, wherein the applying includes applying the set of community preferences during the community event to the first and second gaming terminals.

12. The computer-implemented method of claim 8, wherein the determining of the set of community preferences includes averaging corresponding individual preferences in the first and second sets of preferences.

13. The computer-implemented method of claim 8, wherein each of the first set of individual preferences, the second set of individual preferences, and the set of community includes a preference A, the method further comprising:

receiving, via the electronic input device of the first gaming terminal, an input indicative of a first setting for preference A at the first gaming terminal;

receiving, via the electronic input device of the second gaming terminal, an input indicative of a second setting for preference A at the second gaming terminal; and to determine a community setting for preference A, calculating, by at least one of the one or more processors, an average setting based on the first setting and the second setting.

14. The computer-implemented method of claim 8, further comprising displaying the set of community preferences on a community display.

15. The computer-implemented method of claim 8, further comprising displaying the set of individual preferences on one or more of the electronic display devices of the first and second gaming terminals.

16. A method of operating a gaming system, the gaming system including one or more random element generators, one or more processors, and first and second gaming terminals that are primarily dedicated to playing casino wagering games and that participate in a community event, each of the first and second gaming terminals including an electronic display device and an electronic input device, the method comprising:

generating, by at least one of the one or more random element generators, one or more random elements for the respective casino wagering games;

receiving, responsive to physical inputs to the electronic input devices of the respective first and second gaming terminals, wager inputs to initiate the casino wagering games at the respective first and second gaming terminals;

determining, by at least one of the one or more processors, outcomes of the respective casino wagering games based, at least in part, on the respective one or more random elements;

displaying the outcomes on the electronic display devices of the respective first and second gaming terminals;

selecting, by at least one of the one or more processors, the first and second gaming terminals to participate in the community event independently of one or more individual preferences;

in response to receiving individual settings, adjusting respective sets of the one or more individual preferences associated with players at the first and second gaming terminals;

triggering, by at least one of the one or more processors, the community event in which at least one randomly selected outcome is shared by the first and second gaming terminals;

based on the sets of individual preferences, determining, by at least one of the one or more processors, a set of community preferences; and applying, by at least one of the one or more processors, the set of community preferences to the community event.

17. The computer-implemented method of claim 16, further comprising:

receiving, via the electronic input device at the first gaming terminal, an input indicative of a first individual setting for preference A, preference A being one of the individual preferences and the community preferences;

receiving, via the electronic input device at the second gaming terminal, an input indicative of a second individual setting for preference A;

determining, by at least one of the one or more processors, a community setting for preference A based on the first individual setting and the second individual setting; and applying, by at least one of the one or more processors, the community setting to the community event.

18. The computer-implemented method of claim 16, further comprising displaying the set of community preferences on a community display.

19. A gaming system comprising:

a plurality of gaming terminals that are primarily dedicated to playing respective casino wagering games, each gaming terminal including an electronic display device, an electronic input device configured to receive a physical input from a player to initiate the respective casino wagering games and transform the input into an electronic data signal;

one or more random element generators configured to generate one or more random elements for the respective casino wagering games;

one or more processors configured to:

initiate the casino wagering games in response to the electronic data signals from the respective electronic input devices;

determine outcomes of the respective casino wagering games based, at least in part, on the respective one or more random elements;

direct the electronic display devices to display the outcomes of the respective casino wagering games;

select the plurality of gaming terminals to participate in a community event independently of one or more individual preferences;

in response to receiving individual preference settings, adjust respective sets of the one or more individual preferences associated with players at the respective gaming terminals;

trigger the community event in which the gaming terminals participate;

based on the sets of individual preferences, determine a set of community preferences; and apply the set of community preferences to the community event.

20. The gaming system of claim 19, wherein the individual preferences are selected from a group consisting of a volume preference, a theme preference and a game format preference.

21. The gaming system of claim 19, wherein the determining of the set of community preferences includes calculating average settings based on the individual settings.

22. The gaming system of claim 19, further comprising a community display for displaying the set of community preferences.

* * * * *